US008676106B2

(12) United States Patent
Hara

(10) Patent No.: US 8,676,106 B2
(45) Date of Patent: Mar. 18, 2014

(54) IMAGE HEATING MEMBER, AND IMAGE HEATING APPARATUS HAVING IMAGE HEATING STATION

(75) Inventor: Nobuaki Hara, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 13/195,420

(22) Filed: Aug. 1, 2011

(65) Prior Publication Data

US 2012/0027480 A1 Feb. 2, 2012

(30) Foreign Application Priority Data

Aug. 2, 2010 (JP) ..... 2010-173662

(51) Int. Cl.
*G03G 15/20* (2006.01)

(52) U.S. Cl.
USPC ..... 399/333

(58) Field of Classification Search
USPC ..... 399/333
See application file for complete search history.

(56) References Cited

U.S. PATENT DOCUMENTS

| | | | | |
|---|---|---|---|---|
| 4,813,372 | A * | 3/1989 | Kogure et al. | 118/60 |
| 6,587,656 | B2 * | 7/2003 | Lee et al. | 399/90 |
| 7,382,995 | B2 * | 6/2008 | Itoh et al. | 399/67 |
| 7,907,882 | B2 | 3/2011 | Hara | |
| 2010/0054786 | A1 | 3/2010 | Hara | |
| 2010/0296828 | A1 | 11/2010 | Hara et al. | |

FOREIGN PATENT DOCUMENTS

| | | |
|---|---|---|
| JP | 9-006166 | 1/1997 |

* cited by examiner

*Primary Examiner* — Clayton E LaBalle
*Assistant Examiner* — Victor Verbitsky
(74) *Attorney, Agent, or Firm* — Fitzpatrick, Cella, Harper & Scinto

(57) ABSTRACT

An endless fixing belt includes a heat generation layer configured to generate heat by energization, a rubber layer provided on the heat generation layer, a fluorine resin layer provided on the rubber layer, a first electroconductive layer provided at one longitudinal end portion of the fixing belt, and a second electroconductive layer provided at the other longitudinal end portion and configured to form an energizing path cooperatively with the first electroconductive layer through the heat generation layer. The fluorine resin layer extends to cover a part of the first electroconductive layer and a part of the second electroconductive layer.

12 Claims, 6 Drawing Sheets

IMAGE HEATING MEMBER, AND IMAGE HEATING APPARATUS HAVING IMAGE HEATING STATION

FIELD OF THE INVENTION AND RELATED ART

The present invention relates to an image heating device to be mounted in an image forming apparatus such as an electrophotographic apparatus, and an electrostatic recording apparatus to heat an image formed on a recording medium.

Examples of an image heating apparatus include a heating device for fixing an unfixed image on a recording medium to the recording medium, and a heating device for heating an image on a recording medium to enhance the glossiness of the image.

There have been known various structures and heating methods for an image heating apparatus. In Japanese Laid-open Patent Application H9-006166, a method for supplying a heat generation roller (fixing member), made up of a substrate layer and a heat generation layer, with electric power is disclosed. The object of this proposal is to simplify a fixing device in structure, and also, to improve a fixing apparatus in durability. More concretely, the heat generation roller in this patent application is made up of a substrate, a heat generation layer, an insulation layer, and a power delivery layer. Electrical power is delivered to the heat generation layer by placing an electric power delivery member in contact with the power delivery layer.

The nip in which the image on a recording medium is heated is formed between a heat generation roller and a pressure applying member by pressing the heat generation roller and the pressure applying member against each other.

If a fixing apparatus is structured so that the pressure-applying portion of its pressure applying member is less in dimension in terms of the direction parallel to the axial line of its heat generation roller than the heat generation layer, heat is not robbed from the portions of heat generation layer, which are not pressed by the pressure-applying portion. Therefore, the portion of the heat generation layer that does not come into contact with the pressing portions, substantially increases in temperature.

Therefore, it seems to be reasonable to structure an image heating device so that the length of the pressure-applying portion becomes greater than the heat generation layer in terms of the above-mentioned direction. However, even if the apparatus is structured as described above, the power delivery layer for supplying the heat generation layer with electric power is at each end of the heat generation layer.

Thus, if an image heating device is structured so that the pressure-applying portion becomes longer than the heat generation layer in terms of the above-described direction, the pressure-applying portion presses on each power delivery layer. Since the power delivery layer is not for heating the image on the recording medium, it does not need to be pressed. Thus, from the standpoint of wear and the like attributable to usage, the mechanical load to which the power delivery layer is subjected is desired to be as small as possible.

SUMMARY OF THE INVENTION

Thus, the primary object of the present invention is to provide an image heating device which is smaller than any image heating device in accordance with the prior art, in terms of the amount of mechanical pressure to which the power delivery layer is subjected by the pressure applying member.

According to an aspect of the present invention, there is provided a rotatable image heating member for pressing against a pressure to form a nip for heating an image on a recording material, the image heating member comprising: a heat generation layer for generating heat by electric power supply thereto, the heat generation layer being disposed at a position inside an end of the nip with respect to a rotational axis direction of the image heating member; an electric energy supply layer for electric energy supplying to the heat generation layer, the electric energy supply layer being provided at an end of the heat generation layer and electrically connected with the heat generation layer; an elastic layer provided outside the heat generation layer at a position inside an end of the nip with respect to the rotational axis direction; a surface layer provided outside the elastic layer and extending to an outside of the end of the nip so as to cover a part of the electric energy supply layer.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereafter, the present invention is concretely described with reference to the preferred embodiments of the present invention. Incidentally, even though the present invention is described with reference to the preferred embodiments of the present invention, the embodiments are not intended to limit the present invention in scope in terms of structure. That is, the present invention is also applicable to image heating devices other than those in the preferred embodiments, as long they are compatible with the gist of the present invention in terms of structure.

Embodiment 1

(1) Image Forming Portion

Figure 1:
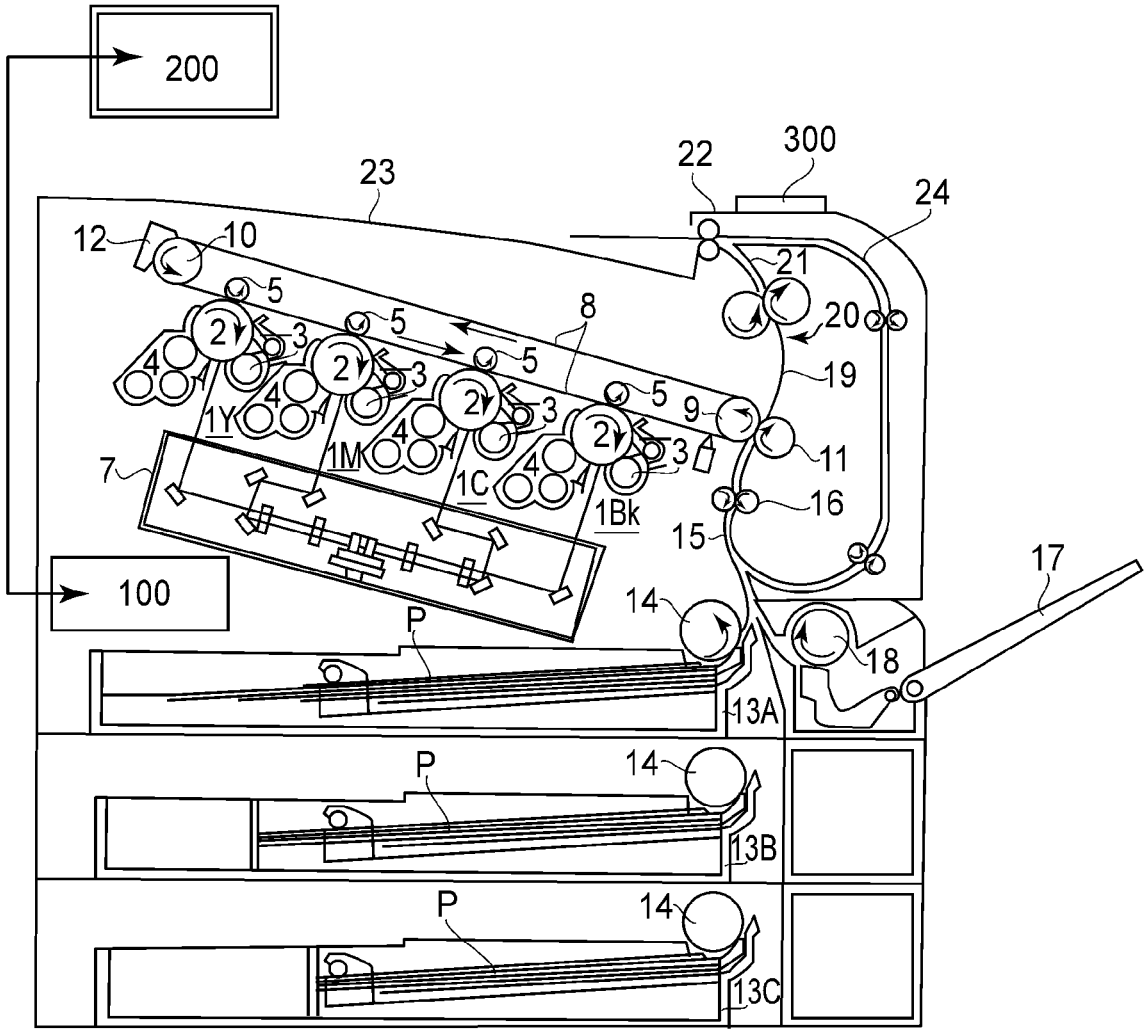
FIG. 1 is a schematic sectional view of the image forming apparatus in the first preferred embodiment of the present invention.

FIG. 1 is a schematic vertical sectional view of an electrophotographic full-color printer as an example of an image forming apparatus having a fixing device 20 as an image heating device in accordance with the present invention. First, its image forming portion is roughly described. This printer is capable of forming (and outputting) a full-color image on a sheet of a recording medium, according to the information of the image to be formed. The information of the image to be formed is inputted from an external host apparatus 200, which is connected to a control portion 100 (control circuit: CPU) of the image forming apparatus, being therefore capable of exchanging information with the control portion 100. The apparatus 200 is a computer, an image reader, or the like. The circuit portion 100 (control) exchanges information with the apparatus 200 and the control panel 300 of the image forming apparatus. It exchanges electrical signals with various image processing devices of the image forming apparatus to control the image formation sequence.

Designated by reference numeral 8 is an intermediary transfer belt, which is flexible and endless. The belt 8 is suspended and kept stretched between a belt-backing second transfer roller 9 and a tension roller 10. As the roller 9 is driven, the belt 8 is circularly moved at a preset speed by the rotation of the roller 9 in the counterclockwise direction indicated by an arrow mark. Designated by a reference numeral 11 is a second transfer roller, which is kept pressed against the roller 9 with the presence of the intermediary transfer belt 8 between the two rollers 11 and 9. The area of contact between the intermediary transfer belt 8 and roller 11 is the second transfer station.

Designated by reference characters 1Y, 1M, 1C, and 1Bk are the first to fourth image forming stations, respectively. They are under the intermediary transfer belt 8, and are in alignment in a straight line in the belt movement direction with preset intervals. Each image forming station is an electrophotographic image forming station, which uses a beam of laser light as its exposing means. It has an electrophotographic photosensitive member 2, which is the form of a drum (and therefore is referred to simply as drum 2, hereafter) as an image bearing member. The drum 2 is rotated in the clockwise direction indicated by an arrow mark, at a preset peripheral velocity. Each image forming station has also a primary charging device 3, a developing apparatus 4, a primary transfer roller 5, and a drum cleaning device 6, which are in the adjacencies of the peripheral surface of the drum 2. The roller 5 is on the inward side of the loop which the intermediary transfer belt 8 forms. It is kept pressed against the drum 2, with the presence of the bottom portion of the intermediary transfer belt 8, in terms of the belt loop, between the roller 5 and drum 2. The area of contact between the drum 2 and intermediary transfer belt 8 is the primary transfer station. Designated by a reference numeral 7 is an exposing device which uses a beam of laser light as its exposing means. The exposing device means 7 exposes the drum 2 of each image forming station. It comprises: a laser light emitting means, a polygon mirror, a deflection mirror, etc. The laser light emitting means emits a beam of laser light while modulating the beam with electrical digital signals which correspond to the pixels, one for one, of the image to be formed, and are in accordance with the information of the image to be formed.

The image forming operation performed by this image forming apparatus is as follows: An image forming operation is started after the information about the image forming operation to be performed, for example, the recording-medium size, data about the image to be formed, the number of prints to be made, etc., which are set by a user, is transferred to the control 100 from the apparatus 200 and/or control panel 300. The control 100 activates and controls each image forming station in response to the image formation signals inputted from the apparatus 200. The image formation signals for forming a copy of an original color image (including black-and-white image) are obtained by separating the color image into monochromatic images of the primary colors of which the original color image is formed. As the four image forming stations 1Y, 1M, 1C, and 1Bk are activated, the four drums 2 are rotated, and yellow, magenta, cyan, and black toner images are formed on the four drums 2, one for one, across their peripheral surface. Incidentally, the principle of the electrophotography, and the electrophotographic process for forming a toner image on the drum 2, are public knowledge, and therefore, are not described here. After the formation of the four monochromatic toner images, different in color, on the four drums 2 in the four image forming stations, one for one, the four images are sequentially transferred (first transfer) in layers onto the intermediary transfer belt 8, which is being circularly moved at the same velocity as the peripheral velocity of each drum 2, in the same direction as the direction of the movement of the peripheral surface of the drum 1, in the first transfer stations, one for one. As a result, an unfixed full-color toner image is synthetically effected by the four monochromatic toner images, different in color, layered in vertical alignment on the surface of the intermediary transfer belt 8.

Meanwhile, the control 100 causes one of the sheet feeder cassettes 13 to feed sheets of a recording medium, the size of which corresponds to the signals inputted regarding the recording-medium size from the apparatus 200, or through the control panel 300, into the main assembly of the image forming apparatus. More specifically, the main assembly of the image forming apparatus is provided with sheet feeder cassettes 13A, 13B, and 13C, which are different in the size (length and width) and the type of a recording medium storable therein, and are vertically stacked. As the image forming operation is started, the control 100 drives the sheet feeding roller 14 of one of the sheet feeder cassettes 13A, 13B, and 13C in which sheets of a recording medium of the chosen size are present. Thus, one of the sheets P of a recording medium in the selected cassette that contains the sheets of the recording medium of the chosen size, is fed into the main assembly while being separated from the rest, and then, is conveyed to a pair of registration rollers 16. When the selected recording medium feeding means is the manual feeder tray 17 (multipurpose tray), the control 100 drives the sheet feeder roller 18, whereby one of the sheets P of the recording medium in the manual feeder tray is fed, while being separated from the rest, into the apparatus main assembly, and then, is conveyed to the rollers 16 through a sheet conveyance path 15. The rollers 16 convey the sheet P of the recording medium with such a timing that the leading edge of the sheet P arrives at the second transfer station at the same time as the leading edge of the full-color toner image, made up of the four monochromatic toner images, on the rotating intermediary transfer belt 8. Thus, as the sheet P is conveyed through the second transfer station, the four monochromatic toner images on the intermediary transfer belt 8 are transferred together (second transfer) onto the sheet P. After being conveyed out of the second transfer station, the sheet P is separated from the intermediary transfer belt 8, and is introduced into a fixing device 20 while being guided by a vertical guide 19. It is by the fixing device 20 that the layered four monochromatic toner images, different in color, on the sheet P are welded (fixed) to the sheet P. As a result, a fixed full-color image is effected on the surface of the sheet P. After being conveyed out of the fixing device 20, the combination of the sheet P and the fixed full-color toner image thereon is conveyed as a full-color print through a recording medium conveyance path 21, and then, is discharged into a delivery tray 23 by a pair of discharge rollers 22. After the separation of the sheet P from the intermediary transfer belt 8 in the second transfer station, the image bearing surface of the intermediary transfer belt 8 is cleaned by a belt cleaning device 12: the toner remaining on the image bearing surface of the intermediary transfer belt 8 after the second transfer is removed by the belt cleaning device 12. Then, the image bearing surface of the intermediary transfer belt 8 is repeatedly used for image formation.

When the apparatus is in the black-and-white mode, only the fourth image forming station Bk that forms a black toner image, is activated and controlled by the control 100. If the apparatus is in the two-side print mode, after the completion of the formation and fixation of an image on one (first) of the surfaces of the sheet P of the recording medium, the sheet P is almost completely conveyed into the tray 23. That is, just before the trailing edge of the sheet P is moved past the roller 22, the roller 22 is reversed in rotation. Thus, the sheet P is fed back into the apparatus main assembly, and then, is introduced into a reconveyance path 24, through which the sheet P is conveyed into the sheet path 15, and conveyed to the pair of registration rollers 16 for the second time. As the sheet P is conveyed into the sheet path 15, the sheet P is positioned so that its second surface faces the intermediary transfer belt 8: the sheet P is positioned upside-down. Thereafter, the sheet P is conveyed through the second transfer station and fixing device, and then, is discharged as a two-sided print into the tray 24.

(2) Fixing Device 20

The fixing device 20 in this embodiment is an image heating device which uses an endless belt having a heat generation layer made of an electrically resistant substance. The belt is not tensioned. An unfixed toner image is heated by the heat generated by the endless belt while the belt is circularly moved. In the following description of the fixing device 20, the "lengthwise" direction of the fixing device 20 and that of each member of the fixing device 20 are the directions perpendicular to the direction in which a sheet of a recording medium is conveyed through recording-medium conveyance paths. That is, the "lengthwise" direction is parallel to the rotational axis of the belt. The "front" side of the fixing device 20 is the side from which a sheet of a recording medium is introduced into the fixing device 20, and the "left" and "right" sides of the apparatus 20 are the left and right sides as seen from the "front" side of the apparatus 20.

Figure 2:
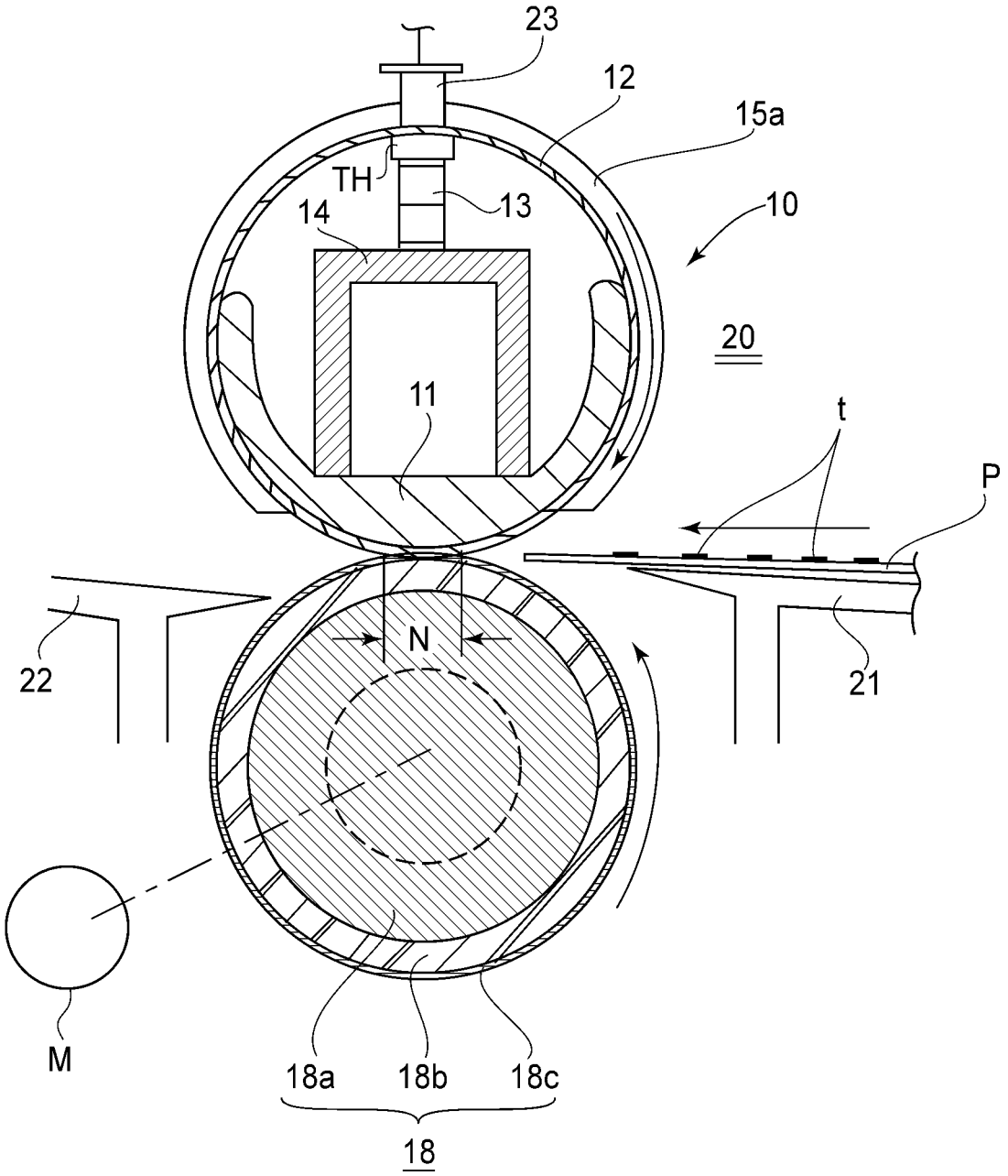
FIG. 2 is an enlarged schematic cross-sectional view of the essential portions of the fixing device in the first preferred embodiment.
Figure 3:
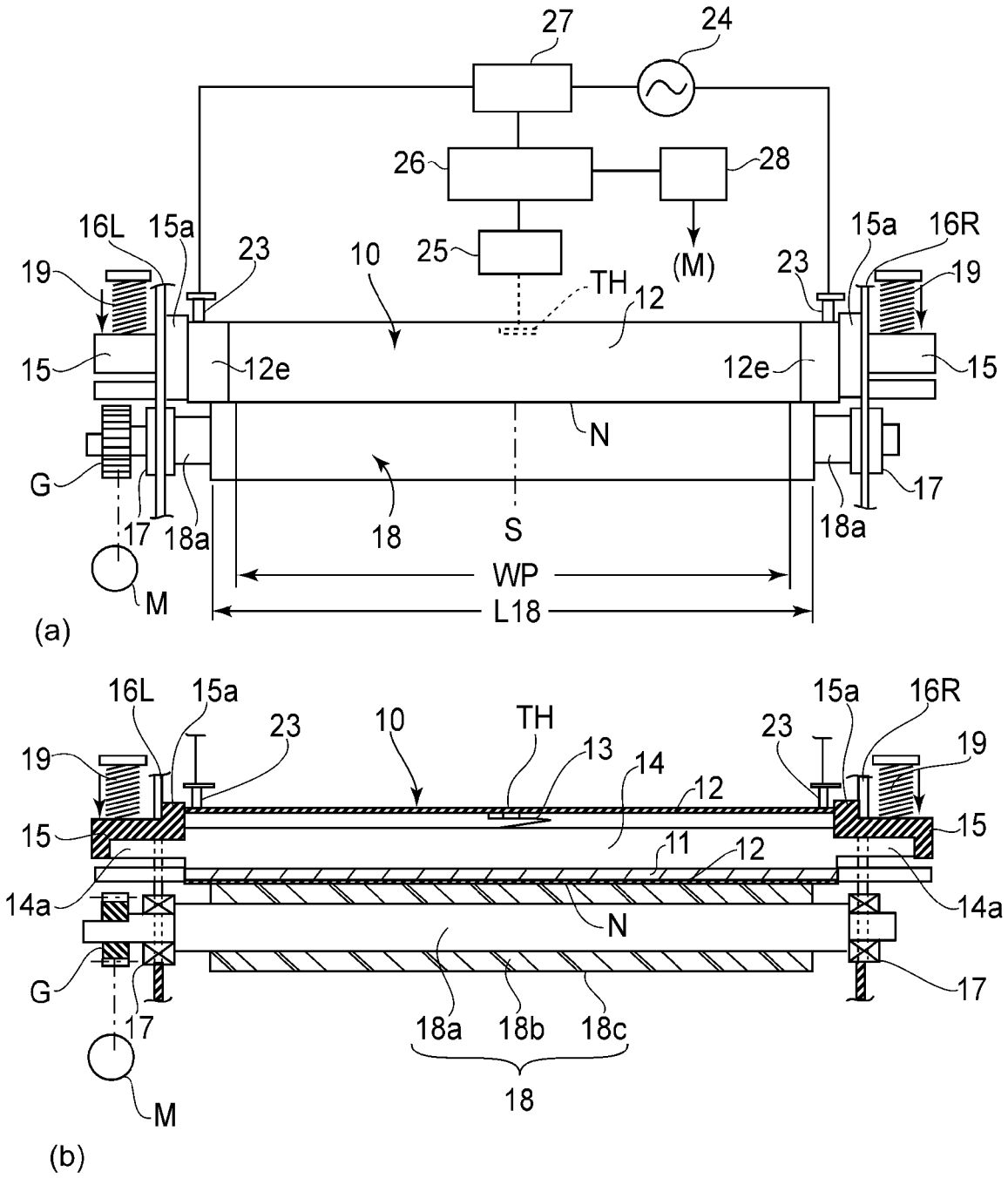
FIG. 3(*a*) is a schematic front view of the essential portions of the fixing device in the first preferred embodiment, and FIG. 3(*b*) is a schematic vertical sectional view of the fixing device, at a plane which coincides with the axial line of the heating belt (stay) and the axial line of the pressure roller.

FIG. 2 is an enlarged schematic cross-sectional view of the essential portions of the fixing device 20. FIG. 3(*a*) is a schematic front view of the essential portions of the fixing apparatus 20, and FIG. 3(*b*) is a schematic vertical sectional view of the essential portions of the apparatus 20, at a plane which coincides with the axial line of the belt 12. Designated by reference numerals 10 and 18 are a fixation belt assembly, and a pressure applying elastic roller, respectively. The fixation nip N is formed by pressing the assembly 10 and pressure applying roller 18 against each other. A portion of the assembly 10, which is designated by a reference numeral 12, is the fixation belt for heating the image on the sheet P of recording medium. The belt 12, which is flexible, is cylindrical (in the form of a cylinder). Designated by a reference numeral 11 is a belt backing member, around which the belt 12 is loosely fitted. The belt backing member 11 is roughly semi-cylindrical in cross-section, and is formed of heat resistant resin. Designated by a reference numeral 14 is a rigid pressure application stay, which is roughly U-shaped in cross section and is in the hollow of the belt-backing member 11. Designated by a pair of reference numerals 15 are a pair of stay holders, one for one, which fit with the arms 14*a* which extend from the left and right ends of the stay 14, one for one. Designated by a pair of reference numerals 15*a* are flange portions of the holders 15, which are integral parts of the holders 15, one for one.

Figure 4:
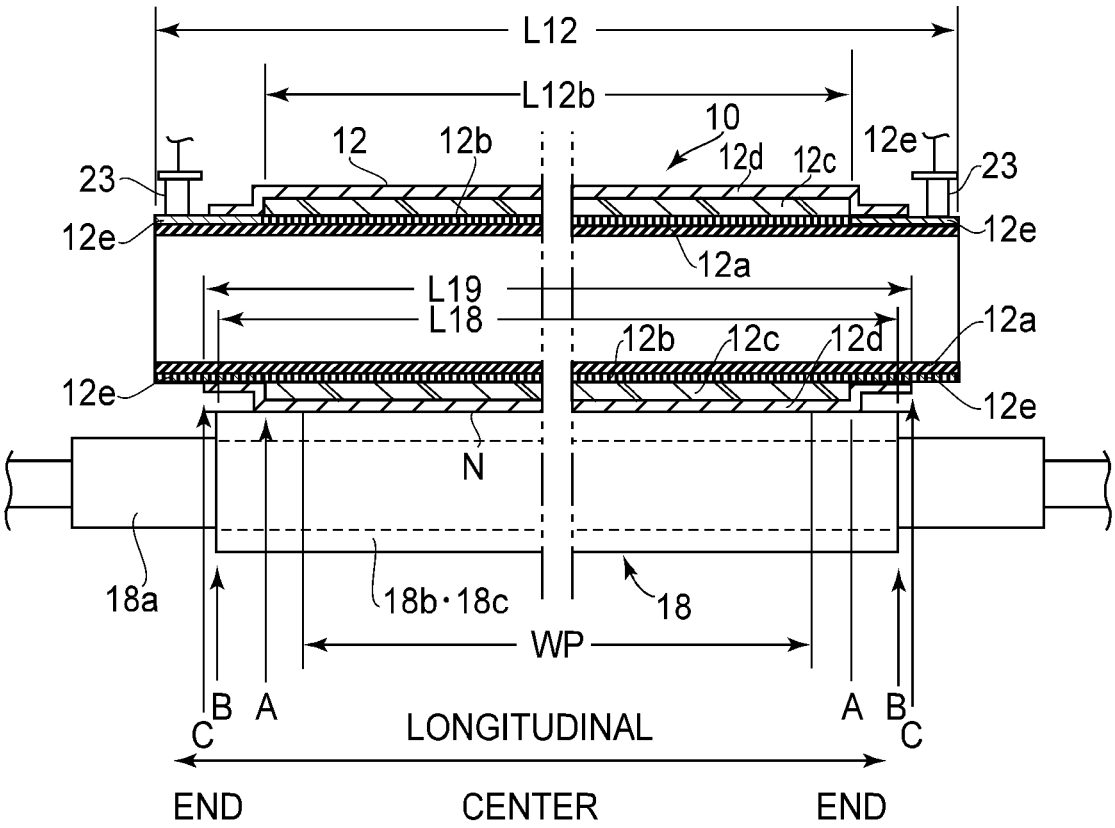
FIG. 4 is a schematic drawing of the essential portions of the lengthwise end portions of the fixing device.

Referring to FIG. 4 which is a schematic drawing of the essential portions of the fixing device 20, the belt 12 has multiple layers, more specifically, a substrate layer 12*a*, a heat generation layer 12*b*, and a parting layer 12*d*. The substrate layer 12*a* is roughly cylindrical. The heat generation layer 12*b* is on the outward surface of the substrate layer 12*a*, and is formed of an electrically resistive substance. The heat generation layer 12*b* covers the entirety of the surface of the substrate layer 12*a*. If necessary, another functional layer may be placed between the heat generation layer 12*b* and parting layer 12*d*. In this embodiment, the belt 12 is provided with an elastic layer 12*c*, which is between the heat generation layer 12*b* and parting layer 12*d*. The elastic layer 12*c* is for controlling the toner when the toner is in the melted state. Further, the belt 12 is provided with a pair of electric power delivery layers 12*e*, which are in the form of a narrow ring and cover the lengthwise end portions of the substrate layer 12*a*. Each power delivery layer 12*e* functions as a low resistance electrode for supplying the heat generation layer 12*b* with electric power. It is electrically in contact with the corresponding lengthwise end of the heat generation layer 12. More specifically, each power delivery layer 12*e* is in the form of a narrow ring, and covers the substrate layer 12*a*, across the area on the outward side of the substrate layer 12*a* in terms of the direction parallel to the lengthwise direction of the fixing device 20, and is electrically in connection with the heat generation layer 12*b*.

The substrate layer 12*a* is made of a heat resistant, electrically insulative, and mechanically strong substance. More concretely, the substrate 12*a* is cylindrical and is formed of polyimide. It is 30 μm in thickness, and 30 mm in internal diameter. Polyimide is such a resinous substance that is heat resistant, electrically insulative, and mechanically very strong. From the standpoint of rigidity, the thickness of the substrate layer 12*a* is desired to be no less than 15 μm. In order to ensure that the belt 12 quickly heats up, the belt 12 is desired to be small in thermal capacity, and therefore, the thickness of the belt 12 is desired to be no more than 100 μm. The heat generation layer 12*b* is made up of a combination of epoxy resin, and additives, such as carbon black powder and graphite powder, and metallic power (silver powder, for example) mixed into the epoxy resin. The additives in this embodiment were carbon black powder and silver powder. As for the elastic layer 12*c*, it is formed of silicon rubber or fluorinated rubber, for example. The elastic layer 12*c* in this embodiment was formed of silicon rubber, and was 300 μm in thickness. The parting layer 12*d* is for facilitating the toner separation from the belt 12, and is formed of fluorinated resin. More concretely, it is a piece of PFA tube which is 30 μm in thickness.

The pressure roller 18 is a multilayer roller made up of a metallic core 18*a*, an elastic layer 18*b*, and a parting layer 18*c*, listing from the inward side of the roller 18. More specifically, the roller 18 is 30 mm in external diameter. The metallic core 18*a* is a solid cylindrical member made of SUS. The elastic layer 18*b* is made of silicon rubber and is 3.0 μm in thickness. The parting layer 18*c* is a piece of PFA tube, which is 30 μm in thickness. The belt pressing portion of the pressure roller 18 is made up of the elastic layer 18*b* and PFA tube 18*c*. The roller 18 is between the left and right lateral plates 16L and 16R of the apparatus frame 16, and is rotatably supported by a pair of bearings 17 positioned between the left and right end portions of the roller 18 and the left and right plates 16L and 16R, respectively. The aforementioned assembly 10 is positioned in parallel to the roller 18 in such an attitude that the downwardly facing side of the belt backing member 11 faces the roller 18. Further, the fixing device 20 is provided with a pair of compression springs 19 (pressure application mechanism), which keep the left and right end portions of the holder 15 pressed toward the axial line of the roller 18 by a preset amount of pressure. That is, the stay 14 is kept pressed toward the axial line of the roller 18. Thus, the downwardly facing surface of the belt backing member 11 is kept pressed upon the pressure-applying portion of the roller 18 against the elasticity of the elastic layer 18*b*. Thus, a fixation nip N, which has a preset width (dimension in terms of recording medium conveyance direction c) and is necessary for the thermal fixation, is formed between the belt 12 and roller 18. More concretely, the amount of the pressure by which the assembly 10 is kept pressed against the roller 18 is 300 N, and the dimension (width) of the nip N in terms of the recording medium conveyance direction c is 8 mm. Designated by reference numerals 21 and 22 are the entrance and exit guides, respectively, attached to the apparatus frame 16.

Designated by a reference character G in FIG. 3 is a drive gear solidly attached to one of the lengthwise ends of the metallic core 18*a* of the roller 18. The rotational force of a fixation motor M is transmitted to this gear G through an unshown power transmitting mechanism. As the force is transmitted, the roller 18 is rotated in the counterclockwise direction, indicated by an arrow mark in FIG. 2. Thus, the belt 12 is rotated by the force transmitted to the roller 18 and the friction between the roller 18 and belt 12 in the fixation nip N. Thus, the belt 12 rotates around the belt backing member 11 in the clockwise direction, indicated by an arrow mark, sliding on the belt backing member 11 by its inward surface, in the fixation nip N. The speed of the belt 12 is roughly the same as the peripheral velocity of the roller 18. The left and right flanges 15*a* and 15*a* play the role of catching the belt 12 as the belt 12 shifts leftward or rightward in terms of the direction parallel to the lengthwise direction of the belt backing member 11 while being circularly moved. That is, as the belt shifts leftward or rightward, it comes into contact with the left or right flange 15*a*, being thereby prevented from becoming excessively off-centered. The inward surface of the belt 12 is coated with grease (lubricant) to ensure that the belt easily slides on the belt backing member 11.

After being introduced into the nip N, the sheet P of the recording medium is conveyed through the nip N by the rotation of the roller 18 and belt 12, while remaining pinched between the roller 18 and belt 12. In this embodiment, the sheet P is conveyed through the nip N in such a manner that in terms of the lengthwise direction of the nip N, the center of the sheet P coincides with the center of the nip N. Thus, when a sheet P of the recording medium is conveyed through the fixing device 20 (fixing nip), it is aligned relative to the fixing device 20 (fixation nip N) so that in terms of the lengthwise direction of the nip N, the center of the sheet P coincides with that of the fixation nip N regardless of its size and the attitude in which it is conveyed. Designated by reference character S is the reference line (theoretical line) for the "central conveyance". Reference characters WP stand for the width of the recording-medium path of the fixing device 20, that is, the dimension of the widest sheet P of the recording medium (in terms of direction perpendicular to recording medium conveyance direction) conveyable through the fixing device 20 (usable with apparatus).

The fixing device 20 is provided with a thermistor TH as a temperature detecting means for detecting the belt temperature to control the belt 12 in temperature. The thermistor TH is on the inward side of the belt loop. More concretely, in order to detect the temperature of the belt portion that falls within the recording-medium path, regardless of the recording-medium size in terms of the lengthwise direction of the fixing device 20, the thermistor TH is placed in such a manner that it contacts roughly the center of the inward surface of the belt 12 in terms of its widthwise direction (lengthwise direction of fixing device), and is enabled to remain in contact with the belt 12 regardless of anomalies in the belt movement. More concretely, an elastic member 13 is solidly attached to the stay 14, and the thermistor TH is attached to the tip of the elastic member 13 so that the thermistor TH is kept in contact with the inward surface of the belt 12 regardless of the anomalies in the movement of the belt 12.

Further, the fixing device 20 is provided with a pair of power delivery members 23, which are held so that they remain elastically in contact with the pair of power delivery portions 12*e* of the belt 12, one for one, which are on the widthwise end portions of the belt 12. The power delivery member 23 is formed of carbon black. As the belt 12 rotates, the power delivery member 23 slides on the power delivery portion 12*e* of the belt 12. Since it is elastically in contact with the power delivery portion 12*e* of the belt 12, it is capable of maintaining electrical contact with the power delivery portion 12*e* regardless of the movement of the belt 12. As electric power is supplied between the left and right power delivery members 23 from an electric power source 24 (AC power source), heat is generated by the heat generation layer 12*b* across the entire range of the heat generation layer 12*b*, whereby the portion of the belt 12 having the heat generation layer 12*b* is heated. Then, the temperature of the belt 12 is detected by the thermistor TH, and the electrical information outputted by the thermistor TH regarding the temperature of the belt 12 is inputted into the control 26 (CPU) by way of an A/D converter 25. The control 26 controls a triac 27, based on the output (information in the form of electrical signals) of the thermistor TH so that the belt temperature remains at a preset level (fixation level). That is, the control 26 controls the electric power which is to be supplied from the AC power source 24 to the power deliver portions 12*e* (heat generation layer 12*b*).

Then, the control 26 begins to rotate the roller 18 by controlling a fixation motor drive circuit 28 in response to a preset control signal. Further, it starts heating the belt 12 by controlling the triac 27. The belt backing member 11 adiabatically holds and guides the belt 12 from the inward side of the belt loop. As the belt 12 becomes stable in speed, and its temperature reaches the preset level, a sheet P of the recording medium, on which an unfixed toner image t is present, is introduced into the nip N from the direction of the image forming stations while being guided by the entrance guide 21, in such an attitude that the image bearing surface of the sheet P faces the belt 12. Then, the sheet P is conveyed, along with the belt 12, through the nip N while being kept in contact with the belt 12. While the sheet P is conveyed through the nip N, heat is applied to the sheet P and the unfixed toner image t thereon, by the heated belt 12, whereby the unfixed toner image t is thermally fixed to the surface of the sheet P. After being conveyed through the nip N, the sheet P is separated from the belt 12 by the curvature of the belt 12, and is further conveyed while being guided by the exit guide 22 to be discharged into the delivery tray 23.

Referring to FIG. 4, reference characters L12, L12b, and L18 stand for the dimension of the belt 12, dimension of the heat generation layer 12*b*, and dimension of the roller 18 (=elastic layer 18*b* (pressure-applying portion)), in terms of the lengthwise direction of the fixing device 20, respectively. Further, reference characters L19 stand for the dimension of the parting layer 12*d* in terms of the lengthwise direction of the fixing device 20. In the case of the fixing device in this embodiment, there is the following dimensional relationship:

L12>L19≥L18>L12b>WP. A reference character C stands for the position of one of the edges of the parting layer 12*d*. The fixing device 20 is structured so that the point C coincides with a point B, or is on the outward side of the point B. Since the fixing device 20 is structured as described above, it does not occur that the roller 18 comes directly in contact with the power delivery layer 12*e*, within the range between the points A and B. Therefore, it does not occur that the power delivery layer 12*e* is frictionally worn by the roller 18. Therefore, the fixing device 20 is more stable in terms of the power supply to the heat generation layer 12*e* than any fixing device 20 in accordance with the prior art. Further, the fixing device 20 has no elastic layer between the points A and B, being therefore significantly smaller in the amount of pressure applied to the power delivery layer 12*e* by the pressure-applying portion. Incidentally, FIG. 4 (schematic drawing of fixing device 20) is drawn as if a space is present between the peripheral surface of the roller 18 and the elastic layer 12*c* by the parting layer 12*d*, in the range between the points A and B of the lengthwise end of the roller 18. In reality, however, the elastic layer 12*c* and parting layer 12*d* are very thin, and further, the elastic layer 12*c* of the belt 12 and the elastic layer 18*b* of the roller 18 are compressed by the pressure applied to keep the assembly 11 in contact with the roller 18. Therefore, as the roller 18 rotates, the portions of the roller 18, which are between the points A and B, remain in contact with the parting layer 12*d*.

In comparison, in the cases of examples of a comparative fixing device, the point A is on the outward side of the point B in terms of the lengthwise direction of the fixing device. Table 1 shows the distance between the points A and B in the fixing devices in the embodiments 1-1-1-3, and examples 1-1-1-4 of a comparative fixing device. In Table 1, if the value (mm) which indicates the distance between the points A and B is positive, it means that the point B is on the outward side of the point A, whereas if it is negative, it means that the point A is on the outward side of the point B.

TABLE 1

| | A-B distance (mm) |
|---|---|
| Embodiment 1-1 | 10 |
| Embodiment 1-2 | 5 |
| Embodiment 1-3 | 1 |
| Comp. Example 1-1 | 0 |
| Comp. Example 1-2 | −1 |
| Comp. Example 1-3 | −5 |
| Comp. Example 1-4 | −10 |

Figure 5:
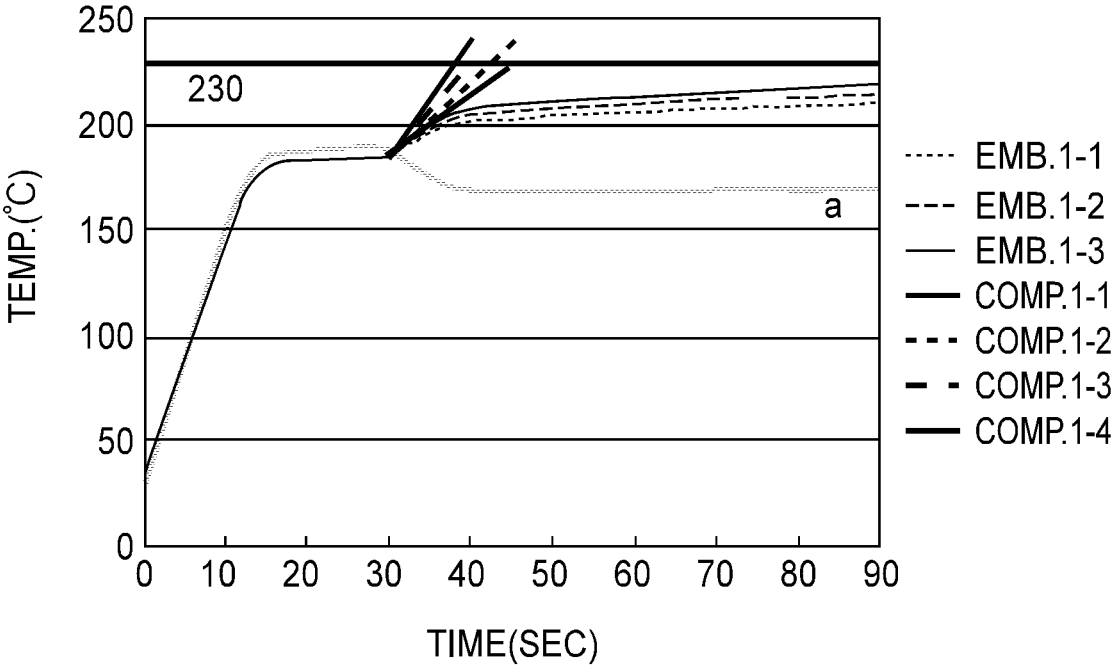
FIG. 5 is a graph which shows the changes in the temperature of the fixation belt of the fixing device in the first embodiment, and those of comparative (conventional) fixing devices.

In the case of the fixing device 20 in this embodiment, the roller 18 was rotated at a peripheral velocity of 246 mm/s, and the belt 12 was moved by the movement of the roller 18. The sheet P of a recording medium used for the test was A4 in size, and 105 g/m$^2$ in basis weight. The sheets P were continuously fed at a rate of 50 sheets per minute, in such an attitude that the lengthwise edges of the sheet P became parallel to the recording-medium conveyance direction. The overall resistance of the heat generation layer 12*b* was 10Ω. Thus, 1,000 W of electric power was delivered to the heat generation layer 12*b* by applying 100 V of AC voltage. The temperature changes which occurred to the areas of the belt 12, which were outside the recording-medium path in terms of the lengthwise direction of the fixing device 20, are given in FIG. 5.

For the first thirty seconds, the belt 12 was increased in temperature, while being rotated, so that the center portion of the belt 12 in terms of the lengthwise direction of the fixing device 20 reached and remained at 190° C. Then, the sheet conveyance was started 30 seconds after the starting of the image forming operation (starting of heating of belt 12). A line a in FIG. 5 stands for the temperature of the center portion of the belt 12 in terms of the lengthwise direction of the fixing device 20. The changes in the center portion of the belt 12 were roughly the same regardless of the position of the point A and that of the point B. Other lines in FIG. 5 stand for the temperature changes which occurred to the portions of the belt 12, which were outside the sheet P path in terms of the lengthwise direction of the fixing device 20, under various conditions (in terms of position of point A and that of point B, and distance between points A and B). In the cases of the fixing devices in the embodiments 1-1-1-3, the temperature of the out-of-sheet-path portion of the belt 12 did not increase beyond 230° C. (which is the highest temperature which PFA tube can withstand) for 60 seconds after the starting of the feeding of a sheet P of recording medium into the fixing device 20, although they were slightly different in the temperature level they reached. In comparison, in the cases of the comparative fixing devices 1-1-1-4, the out-of-sheet-path portion of the belt 12 exceeded 230° C. virtually immediately, that is, within roughly 10 seconds, after the starting of the feeding of the sheet P into the fixing device 20.

Thus, it is evident that from the standpoint of the prevention of an excessive temperature increase of the out-of-sheet-path portions of the belt 12, the fixing device 20 is desired to be structured so that the point B is on the outward side of the point A in terms of the lengthwise direction of the fixing device 20. Referring to FIG. 4, if the fixing device 20 is structured so that the point B is on the inward side of the point A, the heat generated by the portions of the heat generation layer 12*b*, which are between the point which corresponds to the edge of the largest sheet of the recording medium conveyable through the fixing device 20 (usable by image forming apparatus) and the point A cannot be transferred to the roller 18, causing thereby the out-of-sheet-path portions of the belt 12 to excessively increase in temperature. As is evident from FIG. 5, this phenomenon, that is, the excessive temperature increase of the out-of-sheet-path portions of the belt 12, occurs also in a case where the fixing device 20 is structured so that the point A coincides with the point B (example 1-1 of comparative fixing device), because the heat transfer from the belt 12 to the roller 18 is insufficient also in this case. As for the distance between the points A and B, it may be reasonable to say that the distance between the points A and B is desired to be greater by no less than 1 mm (fixing device in Embodiments 1-1-1-3) than the distance in FIG. 5. In other words, structuring the fixing device 20 so that the distance between the points A and B is no less than zero is effective to minimize (prevent) the excessive temperature increase of the out-of-sheet-path portions of the belt 12. Further, it is preferable that the fixing device 20 is structured so that the distance between the points A and B is no less than 1 mm.

Next, the positional relationship between the end of the elastic layer 12*c* and the corresponding end of the heat generation layer 12*b* in terms of the lengthwise direction of the fixing device 20 is described. The position of the end of the elastic layer and that of the corresponding end of the heat generation layer 12*b* practically coincide with each other. In comparison, in a case where the end of the elastic layer 12*c* is on the outward side of the corresponding end of the heat generation layer 12*b*, the pressure from the pressing portion presses on the elastic layer 12*c*, whereby the power delivery layer 12*e* is pressed by the elastic layer 12*c*. Therefore, this setup is not desirable. On the other hand, in a case where the end of the elastic layer 12*c* is on the outward side of the corresponding end of the heat generation layer 12*b*, the portions of the heat generation layer 12*b*, which are not covered with the elastic layer 12*c*, become higher in temperature than the covered portion. However, as long as the distance between the end of the elastic layer 12*c* and the corresponding end of the heat generation layer 12*b* is small, the amount of the temperature increase of the portions of the heat generation layer 12*b*, which are not covered with the elastic layer 12*c*, is relatively small. Therefore, it is desired that the position of the end of the elastic layer 12*c* and that of the heat generation layer 12*b* practically coincide with each other, or the latter is on the outward side of the former. Next, the relationship between the points B and C is described. In a case where the end (point C) of the parting layer 12*d* is on the inward side of the end (point B) of the pressure-applying portion, the pressure-applying portion directly presses on the power delivery layer 12*e*, which possibly increases the amount by which the power delivery layer 12*e* is frictionally worn. Therefore, it is desired that the position of the end of the parting layer is the same as, or on the outward side, of the position of the corresponding end of the pressure-applying portion.

Embodiment 2

In the first preferred embodiment, the fixing device 20 was structured so that the end of the pressure-applying portion of the pressure applying member was on the outward side of the corresponding end of the elastic layer of the belt 12. In comparison, in this embodiment, not only is the fixing device 20 structured so that the end of the parting layer 12*d* of the belt 12 is on the inward side of the corresponding end of the pressuring portion of the pressing member, but also, it is provided with an insulation layer f, the end of which is on the outward side of the corresponding end of the pressure-applying portion of the pressure applying member.

Figure 6:
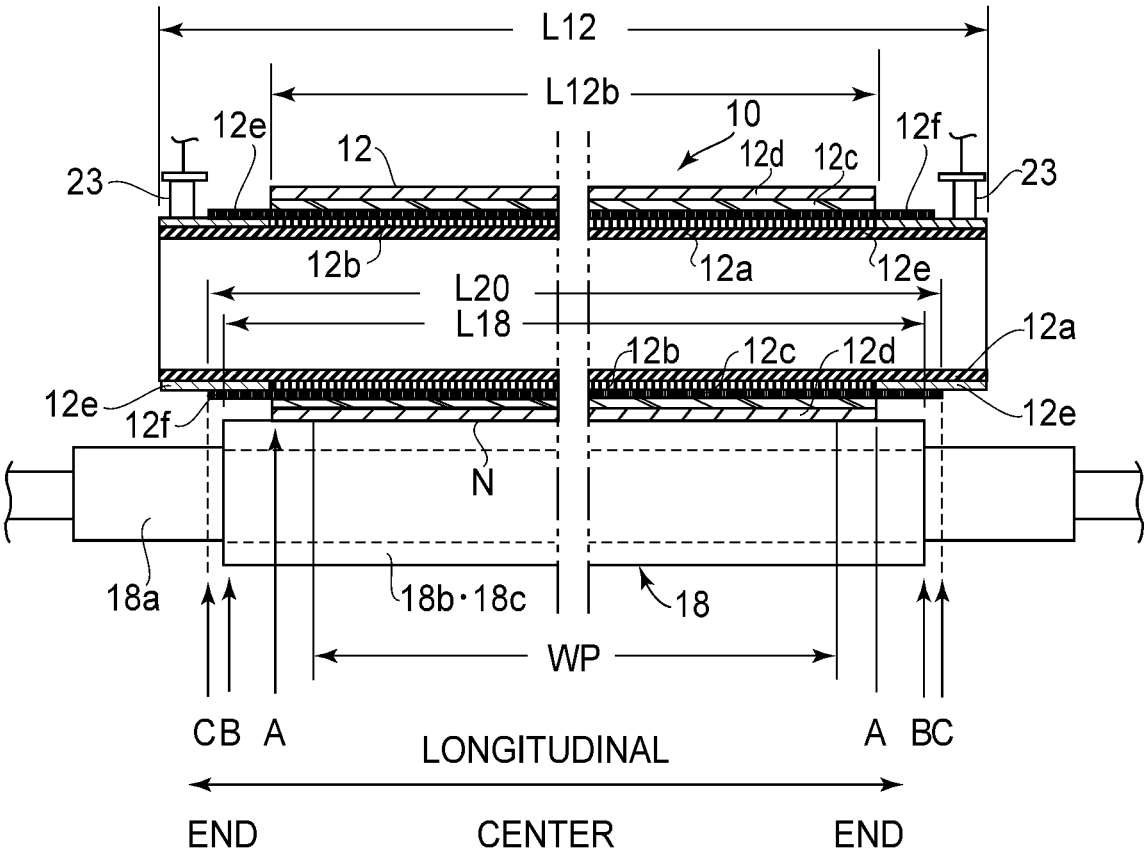
FIG. 6 is a longitudinal cross-section of an apparatus according to another embodiment of the present invention.

FIG. 6 shows the structure of the fixing device in this embodiment. In the following description of this embodiment, if a given component of the fixing device in this embodiment has the same reference characters as the counterpart in the first embodiment, it is the same in structure as the counterpart in the first embodiment, unless specifically noted.

In this embodiment, an insulation layer 12*f* is provided between the heat generation layer 12*b* and elastic layer 12*c*. Further, the position of the end of the parting layer 12*d* and that of the elastic layer 12*c* practically coincide with each other.

First, the insulation layer 12*f* is described. The insulation layer 12*f* is between the heat generation layer 12*b* and elastic layer 12*c*. It is formed of polyimide, and is 10 μm in thickness. In terms of the direction parallel to the rotational axis of the belt 12, its length L20 is greater than the length L12b of the heat generation layer 12*b*. Further, the length L18 of the pressure-applying portion is greater than the length L12b of the heat generation layer 12*b*, but is less than the length L20 of the insulation layer 12*f*. That is, the dimensional relationship among these portions of the belt 12 is: WP<L12b<L18<L20. Structuring the fixing device as described above prevents the roller 18 from coming into direct contact with the power delivery layer 12*e* within the range between the points A and B, preventing thereby the problem that the power delivery layer 12*e* is frictionally worn by the roller 18. Therefore, it ensures that the heat generation layer 12*b* is continuously supplied with a proper amount of the electric power. Further, in this embodiment, no elastic layer is provided between the points A and B. Therefore, the fixing device in this embodiment is smaller in the amount of pressure applied to the power delivery layer by the pressing portion of the pressing member than the fixing device in the first embodiment.

Next, the positional relationship between the end of the elastic layer 12*c* and the corresponding end of the heat generation layer 12*b* is described. The position of the end of the elastic layer 12*c* and that of the heat generation layer 12*b* practically coincide with each other. To elaborate, if the end of the elastic layer 12*c* is on the outward side of the end of the heat generation layer 12*b*, the pressure from the pressure-applying portion of the pressure applying member presses on the elastic layer 12*c*, causing thereby the elastic layer 12*c* to press on the power delivery layer 12*e*. Therefore, this setup is not desirable. On the other hand, if the end of the elastic layer 12*c* is on the outward side of the corresponding end of the heat generation layer 12*b*, the portions of the belt 12, which correspond to the portions of the heat generation layer 12*b*, which are not covered with the elastic layer 12*c*, become higher in temperature than the portion of the belt 12, which corresponds to the portion of the heat generation layer 12*b*, which are not covered with the elastic layer 12*c*. However, as long as the distance between the end of the elastic layer 12*c* and that of the heat generation layer 12*b* is small, the amount of the temperature increase is relatively small. Therefore, it is desired that the position of the end of the elastic layer 12*c* and that of the heat generation layer 12*b* practically coincide with each other, or the latter is on the outward side of the former. In this embodiment, the position of the elastic layer 12*c* and the position of the corresponding end of the heat generation layer 12*b* are practically the same. Incidentally, it is desired that the fixing device is structured so that the position of the end of the elastic layer 12*c* and the position of the corresponding end of the parting layer 12*d* coincide with each other, or the latter is on the outward side of the former. Next, the relationship between the points B and C is described. If the end (point C) of the insulation layer 12*f* is on the inward side of the end (point B) of the pressure-applying portion, the pressure-applying portion directly presses on the power delivery layer 12*e*, which possibly increases the amount by which the power delivery layer 12*e* is frictionally worn. Therefore, it is desired that the position of the end of the insulation layer 12*f* coincides with the position of the corresponding end of the pressure-applying portion, or is on the outward side of the position of the corresponding end of the pressure-applying portion.

[Miscellanies]

1) The present invention is also applicable to a fixing device which has a flexible endless belt and multiple belt suspension rollers, inclusive of a belt driving roller, and is structured so that the endless belt is suspended and kept stretched by the belt suspension rollers, and is circularly driven by the belt driving roller.

2) The present invention is also applicable to a fixing device which employs a heating roller comprising: a substrate 12*a* which is a rigid, dielectric, cylindrical, and hollow or solid roller; and a heat generating resistor layer 12*b*, an elastic layer 12*c*, a power delivery layer 12*e*, etc., layered on the peripheral surface of the substrate 12*a*.

As described above, the present invention can reduce a fixing device in the amount of mechanical load applied to the power delivery layer of the heating member of the fixing device by the pressure applying member of the fixing device, even if the fixing device is structured so that in terms of the direction parallel to the lengthwise direction of the fixing device, the end of the pressure-applying portion of the pressure applying member of the fixing device is on the outward side of the corresponding end of the heat generation layer of the image fixing (heating) member of the fixing device.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 173662/2010 filed Aug. 2, 2010, which is hereby incorporated by reference.

What is claimed is:

1. An endless fixing belt for fixing a toner image onto a recording material, said fixing belt comprising:

a heat generation layer configured to generate heat by energization;

a rubber layer provided on said heat generation layer;

a fluorine resin layer provided on said rubber layer;

a first electroconductive layer provided at one longitudinal end portion of said fixing belt; and a second electroconductive layer provided at the other longitudinal end portion of said fixing belt and configured to form an energizing path cooperatively with said first electroconductive layer through said heat generation layer, wherein said fluorine resin layer is extended so as to cover a part of said first electroconductive layer and a part of said second electroconductive layer.

2. An endless fixing belt according to claim 1, wherein said first electroconductive layer is disposed at a side of one longitudinal end portion of said heat generation layer, and said second electroconductive layer is disposed at a side of the other longitudinal end portion of said heat generation layer.

3. An endless fixing belt according to claim 2, further comprising a base layer, wherein said heat generation layer, said first electroconductive layer and said second electroconductive layer are provided on said base layer.

4. An endless fixing belt according to claim 1, wherein said fluorine resin layer is extended longitudinally outwardly beyond longitudinal end portions of said rubber layer.

5. An endless fixing belt according to claim 1, wherein one longitudinal end portion of said fluorine resin layer is positioned on one longitudinal end portion of said rubber layer, and the other longitudinal end portion of said fluorine resin layer is positioned on the other longitudinal end portion of said rubber layer.

6. A fixing apparatus comprising:

(i) a fixing belt configured to fix a toner image on a recording material at a nip portion, said fixing belt including (i-i) a heat generation layer configured to generate heat by energization;

(i-ii) a rubber layer provided on said heat generation layer;

(i-iii) a fluorine resin layer provided on said rubber layer;

(i-iv) a first electroconductive layer provided at one longitudinal end portion of said fixing belt; and (i-v) a second electroconductive layer provided at the other longitudinal end portion of said fixing belt and configured to form an energizing path cooperatively with said first electroconductive layer through said heat generation layer; and (ii) a drive rotatable member configured to (a) drive said fixing belt to rotate and (b) form the nip portion cooperatively with said fixing belt, wherein said drive rotatable member is extended longitudinally outwardly beyond both longitudinal end portions of said heat generation layer, and wherein said fluorine resin layer extends so as to cover a part of said first electroconductive layer, which is opposed to said drive rotatable member and a part of said second electroconductive layer, which is opposed to said drive rotatable member.

7. A fixing apparatus according to claim 6, wherein said first electroconductive layer is disposed at a side of one longitudinal end portion of said heat generation layer, and said second electroconductive layer is disposed at a side of the other longitudinal end portion of said heat generation layer.

8. A fixing apparatus according to claim 7, further comprising a base layer, wherein said heat generation layer, said first electroconductive layer and said second electroconductive layer are provided on said base layer.

9. A fixing apparatus according to claim 6, wherein said fluorine resin layer is extended longitudinally outwardly beyond longitudinal end portions of said rubber layer.

10. A fixing apparatus according to claim 6, wherein one longitudinal end portion of said fluorine resin layer is positioned on one longitudinal end portion of said rubber layer, and the other longitudinal end portion of said fluorine resin layer is positioned on the other longitudinal end portion of said rubber layer.

11. A fixing apparatus according to claim 6, wherein said drive rotatable member is a drive roller.

12. A fixing apparatus according to claim 6, further comprising a heater provided so as to contact an inner surface of said fixing belt, wherein said heater heats the toner image on the recording material through said fixing belt.

* * * * *